US005370960A

United States Patent [19]

Cahill et al.

[11] Patent Number: 5,370,960

[45] Date of Patent: Dec. 6, 1994

[54] ELECTROGRAPHIC IMAGING PROCESS

[75] Inventors: Douglas A. Cahill, Belchertown; Donald A. Brault, Granby; Richard S. Himmelwright, Wilbraham, all of Mass.

[73] Assignee: Rexham Graphics Incorporated, South Hadley, Mass.

[21] Appl. No.: 42,283

[22] Filed: Apr. 2, 1993

[51] Int. Cl.[5] ..... G03G 13/20

[52] U.S. Cl. ..... 430/124; 430/97; 430/99; 430/126

[58] Field of Search ..... 430/124, 97, 99, 126

[56] References Cited

U.S. PATENT DOCUMENTS

| | | | |
|---|---|---|---|
| 4,007,489 | 2/1977 | Helmberger et al. | 358/78 |
| 4,234,644 | 11/1980 | Blake et al. | 430/124 |
| 4,569,584 | 2/1986 | St. John et al. | 355/14 R |
| 4,731,542 | 3/1988 | Doggett | 250/548 |
| 4,897,327 | 1/1990 | Dubin et al. | 430/126 |
| 4,983,487 | 1/1991 | Gilreath | 430/126 |
| 5,102,768 | 4/1992 | Light et al. | 430/126 |
| 5,108,865 | 4/1992 | Zwaldo et al. | 430/126 |
| 5,217,773 | 6/1993 | Yoshida | 428/40 |

FOREIGN PATENT DOCUMENTS 0437073 7/1991 European Pat. Off. .

*Primary Examiner*—Marion E. McCamish
*Assistant Examiner*—Mark A. Chapman
*Attorney, Agent, or Firm*—Breneman, Georges & Krikelis

[57] ABSTRACT

A novel process for forming protected, electrographic image on a substrate is disclosed. An electrographic element used in the process comprises a supporting layer, a conductive layer, and a dielectric layer. A protective element used in the process comprises a temporary support layer, a protective layer, and an adhesive layer. The novel electrographic imaging process comprises the steps of producing a toned electrographic image on the surface of the electrographic element; applying and adhering the adhesive layer of the protective element to the toned electrographic image to form an imaged composite; removing the supporting layer from the composite to uncover the conductive layer; pressure laminating the final substrate to the conductive layer; and then removing the temporary support layer from the protective layer to form the protected, electrographic image on the substrate of choice. The process is useful in manufacturing protected images of all sizes and is particularly suited to making large format images such as billboards.

32 Claims, 4 Drawing Sheets

ELECTROGRAPHIC IMAGING PROCESS

BACKGROUND OF THE INVENTION

1. Field of the Invention

This invention relates to electrographic processes for making color images. More particularly, this invention relates to electrographic processes and the elements used therein for the production of large size, full color images.

2. Description of Related Art

The use of electrographic processes in the manufacture of multicolor images is well known in the art. In such processes, an electrostatic latent image is produced directly by imagewise depositing charge onto an accepting dielectric surface. Typically, styli are used to create these charge patterns and are arranged in linear arrays across the width of the moving dielectric surface. Such processes and the required apparatus are disclosed for example in U.S. Pat. Nos. 4,007,489; 4,569,584; 4,731,542; and 4,569,584. In U.S. Pat. No. 4,569,584, only one stylus array is used and the accepting surface web is traversed to-and-fro to make successive images, the toning stations being disposed on either side of the single charging station. In the other designated U.S. patents, the electrographic printer consists; of three or more printing stations in sequence, each containing charging arrays and toning stations. In all of the disclosed processes, a multicolor toner image is assembled on an accepting surface of a support and fixed there for display.

A method for transferring a fixed image, such as an electrographically produced toner image, from an initial substrate to a final substrate is disclosed in U.S. Pat. No. 4,983,487. The disclosed method employs an adhesive-coated film to lift the image from its initial substrate and to secure it to the final substrate. The film remains in place after the transfer is completed and serves to encapsulate and protect the image. The initial substrate remains intact and may be reused.

A transfer process is disclosed in U.S. Pat. No. 5,102,768 for providing a non-electrostatically transferred toned image. In this process, an electrostatic latent image is conventionally formed on the surface of an element and that element is conventionally developed into a visible image by applying toner powder. The toned image is then thermally transferred from the surface of an element by contact to the face of a thermoplastic film that is strippably laminated to a paper or like backing. The film is then positioned against a receiver with the toner image therebetween, and the composite is subjected to two successive stages of compressive heating. It is disclosed that the process produces high resolution images from very small particle size toner powder on rough paper.

An offset transfer process of electrographically produced toner images is disclosed in U.S. Pat. No. 5,108,865. In the disclosed process, a liquid toned image is generated on the surface of an electrographic element. The image is adhered to the adhesive surface of a temporary receptor sheet which comprises a carrier layer, releasable release layer, and a transferable adhesive layer secured to the release layer. The temporary receptor sheet with the image adhered thereto is removed from the electrographic element, and then image surface of the temporary receptor sheet is contacted with a final receptor surface. The adhesive layer secures the toner image, adhesive layer and release layer to the final receiving layer and the carrier layer is removed from the release layer to generate the final image wherein the release layer now is a top protective layer.

A toner developed electrostatic imaging process for outdoor signs is disclosed in European Patent Publication No. 0437073 A2 (E.P. Application No. 90313976.4). This publication describes an electrographic imaging process (as contrasted to an electrophotographic process), in which electrostatic images are toned in sequence to form an intermediate image on a temporary dielectric receptor. The intermediate image is then transferred from the temporary dielectric receptor to a permanent receptor. In the disclosed process certain relative properties of the toner and the intermediate image, such as surface energy, Tg, work of adhesion, and complex dynamic viscosity, were identified as being important to the production of good final images.

Each of the electrographic processes disclosed in the patent publications discussed supra, employ a transfer of the toned image from an electrographic element to the final substrate using an intermediate transfer element. Although advances have been made in retaining the integrity of the toned image, such transfer steps remain prone to image degradation by abrasion or chemical interaction unless added laminating or coating steps are used. There continues to be a need for a simplified process to provide protected, distortion-free, full-color images, particularly, for use on large format posters, billboards and the like.

SUMMARY OF THE INVENTION

These needs are met by the electrographic imaging process of this invention which is a process for forming an electrographic image on a receptor substrate comprising the steps:

A) producing on the surface of an electrographic element a toned image layer, wherein the electrographic element comprises in the order given;

1) a first carrier layer, 2) a conductive layer, and 3) a dielectric layer, wherein the toned image layer is adhered to the dielectric layer to produce an imaged electrographic element;

B) applying to the toned image layer, a protective element which comprises in the order given;

4) an adhesive layer, 5) a protective layer, and 6) a second carrier layer, wherein the adhesive layer is adhered to the surface of the toned image layer to form an image composite element;

C) removing the first carrier layer from the image composite element to uncover the conductive layer of the image composite element;

D) pressure laminating the receptor substrate to the uncovered conductive layer of the image composite element, to form a laminated image element; and E) removing the second carrier layer from the laminated image element.

BRIEF DESCRIPTION OF THE DRAWINGS

The invention can be more fully understood from the following description thereof in connection with the accompanying drawings described as follows.

DETAILED DESCRIPTION OF THE INVENTION

The present invention relates to a novel process for forming an electrographic image on a receptor substrate using an electrographic element and a protective element. The electrographic element comprises, in the order given, a first carrier layer, a conductive layer, and a dielectric layer. The protective element comprises, in the order given, an adhesive layer, a protective layer, and a second carrier layer. The novel electrographic imaging process comprises the steps: A) producing on the surface of the electrographic element a toned image layer, wherein the toned image layer is adhered to the dielectric layer to produce an imaged electrographic element; B) applying to the toned image layer, the protective element wherein the adhesive layer is adhered to the surface of the toned image layer to form an image composite element; C) removing the first carrier layer from the image composite element to uncover the conductive layer of the image composite element; D) pressure laminating the receptor substrate to the uncovered conductive layer of the image composite element, to form a laminated image element; and E) removing the second carrier layer from the laminated image element.

Figure 1:
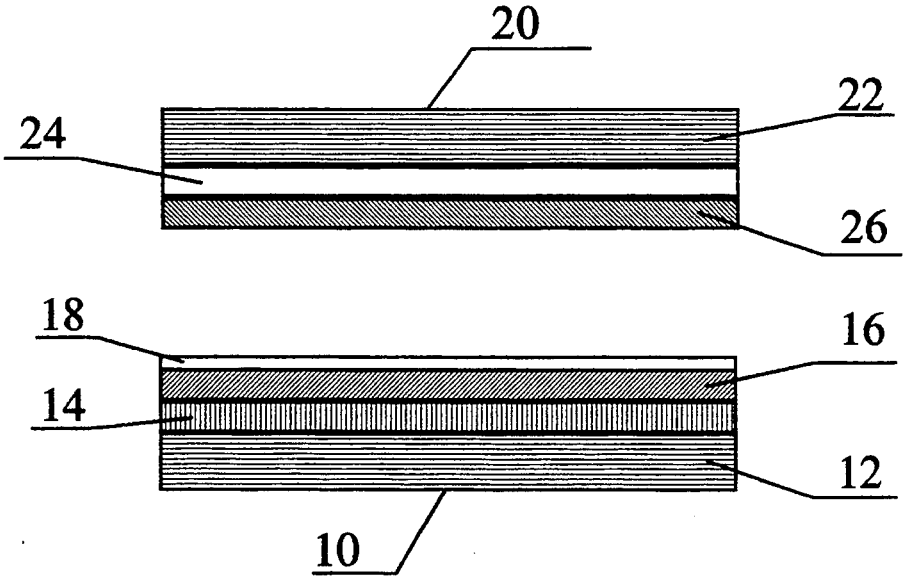
FIG. 1 is a cross section view illustrating details of the imaged electrographic element and the protective element used in the process of this invention.

The electrographic process of this invention will now be described by reference to the accompanying drawings. Throughout the following description, similar reference characters refer to similar elements in all figures of the drawings. Referring to FIG. 1, an imaged electrographic element (10) comprises a first carrier layer (12), a conductive layer (14), a dielectric layer (16), and a toned image layer (18). The first carrier layer (12) functions as a support to the superposed layers during the process steps of this invention and may be any web or sheet material possessing suitable flexibility, dimensional stability and adherence properties to the conductive layer (14). Typically, the web or sheet material is a flexible polymeric film, e.g., such as polyethylene terephthalate film and the like, or a foraminous material, e.g., such as a paper sheet and the like. The web or sheet may also be surface treated or coated with a material to enhance desired surface characteristics.

The conductive layer (14) of this invention comprises a film-forming, organic material, e.g., such as a cation type styrene-methacrylate copolymer having an electrical resistivity of about 1 to 30 meg-ohm per □. Suitable film-forming, organic materials include polymeric quaternary ammonium compounds, polystyrene sulfonic acid, polymeric matricies capable of ionizing inorganic electrolytes contained therein, and the like. The film-forming, organic material may be used alone or with conductive, inorganic materials and/or metals dispersed therein, e.g., such as tin oxide, aluminum and the like.

The dielectric layer (16) which is permanently adhered to the conductive layer (14), may be any conventional film-forming material having a dielectric constant of about 2 to about 5. This layer typically has a thickness in the range of about 1 μm to about 20 μm and preferably in the range of about 5 μm to about 15 μm. This layer typically comprises one or more polymers selected from polyvinylacetate, polyvinylchloride, polyvinylbutyral, polymethylmethacrylate, styrenated acrylics, styrene acrylonitrile, and the like. Other ingredients may be chosen from waxes, polyethylene, alkyd resins, nitrocellulose, ethylcellulose, cellulose acetate, shellac, epoxy resins, styrene-butadiene copolymers, clorinated rubbers, polyacrylates, and the like. The surface of such a layer is advantageously rough to ensure good transfer of charge during passage under the stylus bar. This roughness can be obtained by including in the layer particles sufficiently large to give surface irregularities to the layer. Particles of average diameter in the range of about 1 μm to about 15 μm are suitable. Particle composition and size are chosen to give the required dielectric constant to the layer as well as the appropriate surface topography and abrasive properties to the layer. The property requirements of the dielectric layer (16) are well known in the art as disclosed, for example, in U.S. Pat. Nos. 3,920,880 and 4,201,701.

The toned image layer (18) is produced in the first step (not shown in the accompanying drawings) of the process of this invention. Any conventional electrostatic process may be used to form the toned image layer (18) on the surface of the dielectric layer (16), e.g., such as those processes (and required apparatus) which are disclosed in U.S. Pat. Nos. 4,007,489; 4,569,584; 4,731,542; and 4,569,584, and in European Patent Publication No. 0437073 A2 (E.P. Application No. 90313976.4) discussed supra. In such processes, an electrostatic latent image is produced directly by imagewise depositing charge onto an accepting dielectric surface. Typically, styli are used to create these charge patterns and are arranged in linear arrays across the width of the moving dielectric surface.

Referring again to FIG. 1, a protective element (20) is comprised of a second carrier layer (22), a protective layer (24), and an adhesive layer (26).

The second carrier layer (22) functions as a temporary support to the superposed layers during the process steps of this invention and may be any web or sheet material possessing suitable flexibility, dimensional stability and adherence properties to the protective layer (24). Typically, the web or sheet material is a flexible polymeric film, e.g., such as polyethylene terephthalate film and the like, or a foraminous material, e.g., such as a paper sheet and the like. The web or sheet may also be surface treated or coated with a material to enhance desired release characteristics, e.g., such as treatment with a silicone release agent and the like.

The protective layer (24) is a polymeric film material which is resistant to scratching, abrasions and the like, and to environmental components and contaminants. The protective layer (24) is visually transparent in at least one region within the visible spectral region and typically is transparent throughout the visible spectral region. Polymeric materials which are useful in making this layer include polyvinyl chloride; polyvinyl butyral; cellulose acetate propionate; cellulose acetate butyrate; polyesters; acrylics; polyurethanes; styrene copolymers, e.g., such as styrene acrylonitrile; and combinations thereof. This layer may contain components which strongly absorb ultraviolet radiation thereby reducing damage to underlying images by ambient ultraviolet light, e.g., such as 2-hydroxybenzophenones; oxalanilides; aryl esters and the like; hindered amine light stabilizers, such as bis(2,2,6,6-tetramethyl-4-piperidinyl) sebacate and the like; and combinations thereof. The protective layer may be provided with a matt surface. This matt surface can be obtained by including in the layer particles sufficiently large to give surface irregularities to the layer. Particles of average diameter in the range of about 1 μm to about 15 μm are suitable. This layer typically has a thickness in the range of about 0.5 μm to about 10 μm and preferably in the range of about 1 μm to about 4 μm. Such layers typically will withstand scribing with the point of a 4H pencil without breakthrough.

The adhesive layer (26) functions to permanently adhere the protective layer (24) to the toned image layer (18) of the image composite element during the process of this invention. As with the protective layer (24), the adhesive layer (26) is visually transparent in at least one region within the visible spectral region and typically is transparent throughout the visible spectral region. In the instance where both the adhesive layer (26) and the protective layer (24) are visually transparent in one region, at least a portion of the regions should be common to both layers. The adhesive layer (26) may be chosen from a variety of conventional adhesive materials, e.g., such a thermally activated, pressure sensitive, or photo activated adhesives, and the like. Typically, the adhesive material will be a thermally activated adhesive material comprised of thermoplastic polyurethanes; polycaprolactone; acrylic copolymers; and combinations thereof. Representative thermally activated adhesive materials include Morthane® CA-116 urethane resin (a product of Morton International); Tone® Polymer P767E biodegradable plastic resin (a product of Union Carbide); Elvax® 240 vinyl resin (a product of Dupont Chemicals); and the like. This layer may also contain components which strongly absorb ultraviolet radiation thereby reducing damage to underlying images by ambient ultraviolet light such as described for the protective layer (24) supra.

The electrographic imaging process of this invention comprises five process steps of which the initial process step (A) of producing an imaged electrographic element (10) has been described supra by reference to FIG. 1. The remaining steps of the process may be described by reference to FIGS. 1 and 2.

Figure 2A:
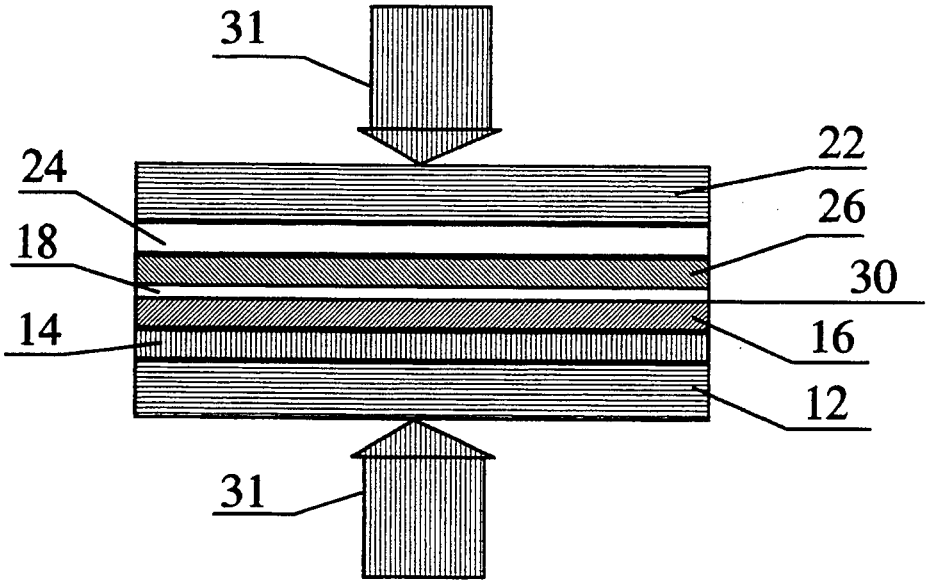
FIGS. 2a, 2b, 2c & 2d are cross section views illustrating the subsequent process steps of this invention.

The second process step (B) comprises applying to the toned image layer (18) of the imaged electrographic element (10), the surface of the adhesive layer (26) of the protective element (20). Referring to FIG. 2a, the adhesive layer (26) is contacted and adhered to the toned image layer (18) using an applied pressure (31) to the surfaces of the carrier layers (12) and (22) to form an image composite element (30). When only a pressure sensitive adhesive is used, the applied pressure (31) must be sufficient to activate the adhesive to form a permanent bond between the layers. The protective element (20) is typically applied to the toned image layer (18) under an applied pressure (31) of about 70 kg/cm$^2$ (1,000 p.s.i.) or greater and preferably under an applied pressure (31) of about 105 kg/cm$^2$ (1,500 p.s.i.) or greater. The term "applied pressure" is intended to mean the absolute pressure which is applied to a unit area of the surface as conventionally derived from the geometry of the pressure means, e.g., the geometry of the laminating nip, in combination with a measurement means, e.g., a calibrated gauge pressure. Suitable means that may be used to apply pressure include platen presses; counterpoised, double roll, laminating devices; scanning, single roll, laminating devices; hand-held, rollers and squeegees; and the like. Typically roll laminating devices are preferred since they readily minimize air entrapment between the adhesive layer (26) and the toned image layer (18) during the application process step. Vacuum may be applied with such devices to further eliminate air entrapment. Typically, the adhesive layer (26) is a thermally activated adhesive. In this instance, heat is typically applied to the adhesive layer (26) prior to and/or concurrently with the application of the applied pressure (31). While the temperature used to activate the adhesive depends on the nature of the material, the protective element (20) is applied to the toned image layer (18) at a temperature of about 80° C. or greater and preferably about 100° C. or greater. Typical application temperatures range from about 100° C. to about 200° C. Typically, temperature is measured on the surface of the heated roll or platen by means of temperature sensitive tape. Thus the protective element (20) may be heated prior to its application by radiant or contact heaters and then applied while hot to the toned image layer (18). Alternatively the pressure means itself may also function as a heater, e.g., such as a hot roll laminator, or both prior and concurrent hating may be used in combination. The adhesive layer (26) may also be a photo activated adhesive. In this instance, the adhesive layer typically is irradiated with actinic radiation either concurrently with or subsequent to the application of the applied pressure (31). In this instance, the second carrier layer (22) and the protective layer (24) should be sufficiently transparent to the actinic radiation which activates the photo adhesive. When the adhesive layer (26) is thermally or photo activated, the applied pressure (31) may be just sufficient to bring the surface of the adhesive layer (26) into intimate contact with the surface of the toned image layer (18).

Figure 2B:
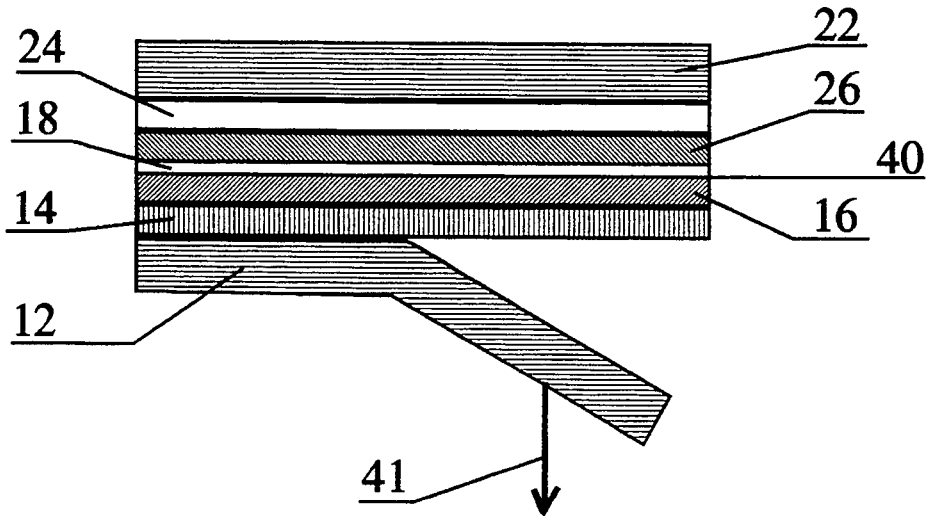

The third process step (C) comprises removing the first carrier layer (12) from the surface of the conductive layer (14) of the image composite element (30). Referring to FIG. 2*b*, the first carrier layer (12) is peeled, using a peel force (41), from the surface of the conductive layer (14) to form second image composite element (40). Typically, the first carrier layer (12) is peeled with a peel force (41) directed at an angle of 90° or more from the surface of the conductive layer (14). The peel rate and the peel force (41) are not critical and preferred values will depend on the nature of the conductive and carrier materials. The temperature at which the first carrier layer (12) is peeled form the conductive layer (14) will depend on the nature of the adhesive, conductive and carrier materials used in the image composite element (30). Typically, the image composite element (30) is heated to facilitate removal of the first carrier layer (12). When a thermally activated adhesive material is used to form the image composite element (30), it surprisingly has been found that the first carrier layer (12) can be removed immediately after formation of the image composite element. (30) (i.e., while still in a heated state from the application process step (B)) without delamination of the thermal adhesive layer (26) or any of the other component layers. Moreover, there is substantially no conductive material removed with the first carrier layer (12) in this instance. In this context, the term "immediately" is intended to mean a time span of about 1 minute or less and preferably between about 1 second and about 20 seconds. Alternatively, when a thermally activated adhesive material is used to form the image composite element (30), the formed element may be cooled and stored before removal of the first carrier layer (12). In this instance the image composite element (30) is reheated prior to removal of the first carrier layer (12). Typically, the element is reheated to a temperature which is within about ±5° C. of the temperature used to form the element in process step (B). After reheating, the first carrier layer (12) can be removed from the image composite element (30) without delamination of the thermal adhesive layer (26) or any of the other component layers and with substantially no removal of conductive material with the first carrier layer (12).

Figure 2C:
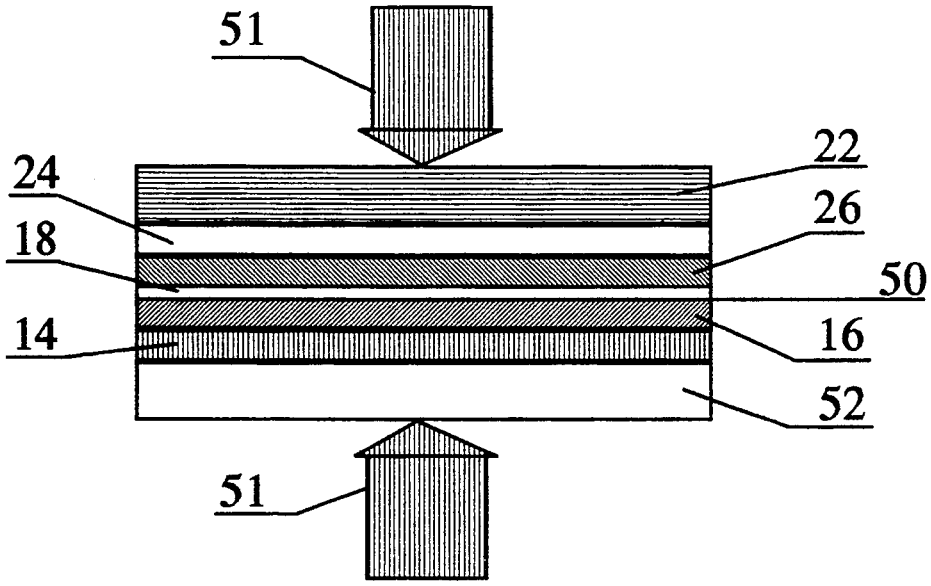

The fourth process step (D) comprises pressure laminating a receptor substrate to the surface of the conductive layer (14) of the second image composite element (40). Referring to FIG. 2c, the receptor substrate (52) is contacted and pressure laminated to the conductive layer (14) using an applied pressure (51) to the surfaces of the second carrier layer (22) and receptor substrate (52) to form a laminated image element (50). The receptor substrate (52) typically is pressure laminated to the contiguous surface of the second image composite element (40) under an applied pressure (51) of about 70 kg/cm$^2$ (1,000 p.s.i.) or greater but may range from about 50 kg/cm$^2$ to about 90 kg/cm$^2$ or more. Suitable means that may be used to apply pressure include platen presses; counterpoised, double roll, laminating devices; scanning, single roll, laminating devices; and the like. When the receptor substrate (52) has an air impervious surface, roll laminating devices are preferred since they readily minimize air entrapment between the conductive layer (14) and the receptor substrate (52) during the pressure laminating process step. Heat may be used prior to and/or concurrently with the application of the applied pressure (51) to accelerate the pressure lamination. Thus the receptor substrate (52) and/or the second image composite element (40) may be heated prior to pressure lamination by radiant or contact heaters and then laminated while hot. Alternatively the pressure means itself may also function as a heater, e.g., such as a hot roll laminator, or both prior and concurrent hating may be used in combination. The laminating temperature may range from about 70° C. to about 150° C. and preferably between about 90° C. and about 110° C.

The receptor substrate (52) typically functions as the final support for the laminated image element (50) formed during the process steps of this invention. The receptor substrate (52) may be any surface upon which an electrographic image is desired. Typically, it is a web or sheet material possessing dimensional stability and adherence properties to the conductive layer (14) of the laminated image element (50). The web or sheet material may be a flexible polymeric film, e.g., such as polyethylene terephthalate film and the like; a foraminous material, e.g., such as a paper sheet, textile fabrics, and the like; metal films or webs, e.g., such as aluminum, steel, tin-plate, and the like; or any composites or laminates thereof. The receptor substrate (52) may be a rigid or semi-rigid sheeting or plate, e.g., such as sheeting or plates of metal, glass, ceramic, plastic, cardboard, or any composites or laminates thereof. The receptor substrate (52) may vary in size from that of a photographic print, e.g., having an area of about 30 cm$^2$ or less, to that of billboards, e.g., having an area of about 70 cm$^2$ or greater. The web or sheet may also be surface treated or coated with a material to enhance desired surface characteristics.

Figure 2D:
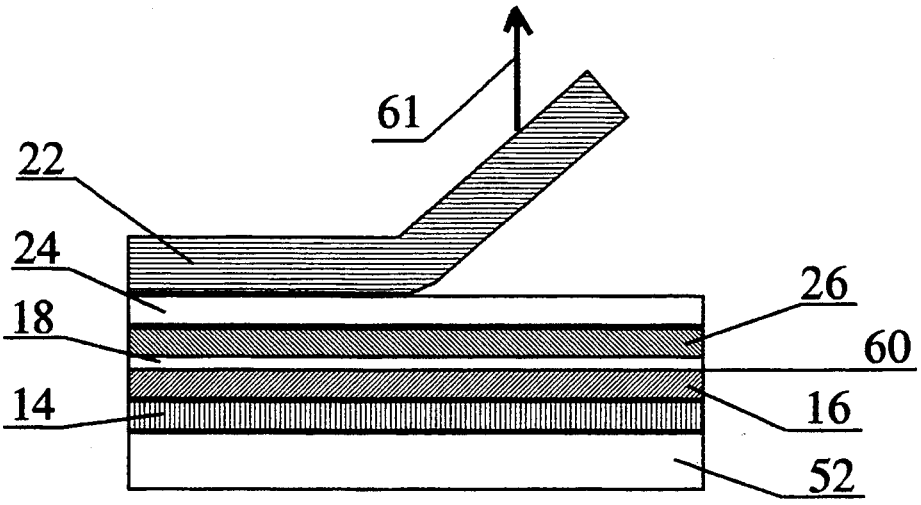

The fifth process step (E) comprises removing the second carrier layer (22) from the surface of the protective layer (24) of the laminated image element (50). Referring to FIG. 2d, the second carrier layer (22) is peeled, using a peel force (61), from the surface of the protective layer (24) to form the completed electrographic image (60). Typically, the second carrier layer (22) is peeled at room temperature with a peel force (61) directed at an angle of 90° or more from the surface of the protective layer (24). The peel rate and the peel force (61) are not critical and preferred values will depend on the nature of the protective and carrier materials. The second carrier layer (22) may be removed at any time after the formation of the laminated image element (50) and may be left adhered for extra protection during storage. While the second carrier layer (22) typically is removed at room temperature, the laminated image element (50) may be heated to facilitate removal.

Figure 3:
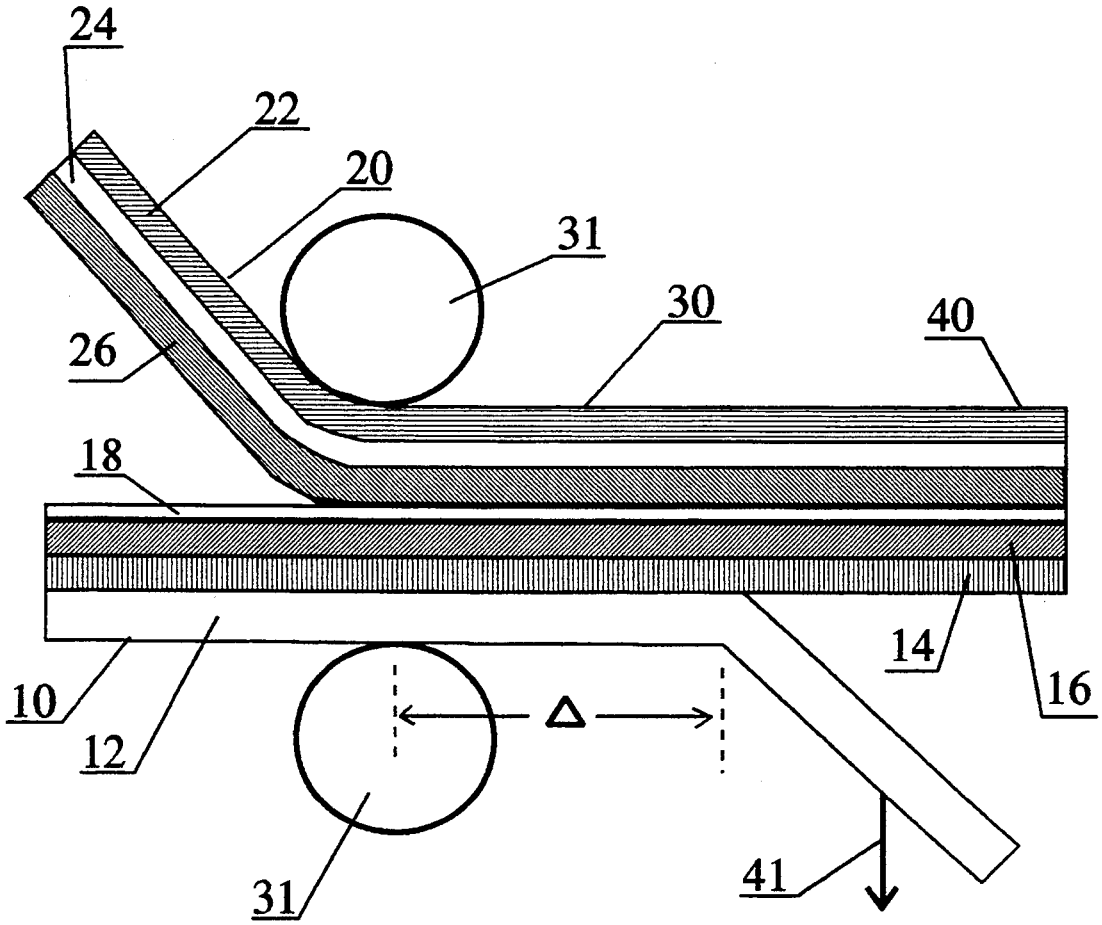
FIG. 3 is a cross section view illustrating the embodiment of this invention wherein the carrier layer is removed from the conductive layer immediately after formation of the image composite element.

The embodiment of the electrographic imaging process of this invention wherein the first carrier layer (12) is removed from the conductive layer (14) immediately after formation of the image composite element (30), is illustrated by reference to FIG. 3. In this embodiment, the adhesive material is a thermally activated adhesive. Referring to FIG. 3, an imaged electrographic element (10) and a protective element (20) are introduced into the nip of a pair of pressure laminating rolls (31) so that the thermally activated adhesive layer (26) is in surface-to-surface contact with the toned image layer (18). In this embodiment, the adhesive layer is heated either prior to entry of the elements into the nip (not shown in the figure) or by means of at least one heated pressure roll (31), which generally is in surface contact with the second carrier layer (22) of the protective element (20). Alternatively, both pressure rolls (31) may be heated and the protective element may be preheated. Typically, the elements are fed through the pressure laminating rolls (31) at a substantially constant rate to insure uniform heating and adhesion along the length of the image composite element (30). In the present embodiment, the first carrier layer (12) is removed from a portion of the image composite element (30) after a time duration, Δ, which is preferably within about 3 seconds from the time at which the portion of the image composite element (30) exits the nip of the pressure rollers (31). In the practice of this embodiment employing a constant feed and heating rate, the first carrier layer (12) is peeled from the conductive layer (14) using a constant peel force (41) at a designated distance from the nip, Δ, (which is a measure of the time duration) to form the second image composite element (40).

The electrographic process of this invention will now be illustrated by the following examples but is not intended to be limited thereby.

EXAMPLE 1

An electrographic element was prepared as follows: A conductive coating solution was prepared from the following ingredients:

| Ingredient | Parts By Weight |
|---|---|
| Methyl alcohol | 80.0 |
| Deionized water | 12.0 |
| Chemistat ® 6300H[1] electroconductive polymer | 8.0 |

[1]Chemistat ® 6300H electroconductive polymer is a product of Sanyo Chemical Industries and is a cation type styrene-methacrylate copolymer in aqueous solution.

The above ingredients were added in the order shown and mixed in a Lightnin® mixer for 5 minutes. The coating was then applied to a 0.001 inch (~127 μm) thick, untreated, polyethylene terephthalate film with a meyer rod and dried in an air dried oven at 240° F. (~115° C.) for two minutes to give a dry coating thickness of 2 μm.

A dielectric layer coating solution was prepared from the following ingredients.

| Ingredient | Parts By Weight |
|---|---|
| Propylene glycol monomethyl ether | 7.32 |
| Toluene | 21.96 |
| Acrylic resin(2) | 56.44 |
| Amorphous silica slurry (ave. particle size 9 μm) | 12.58 |
| Calcined clay(3) (ave. particle size 0.8 μm) | 1.70 |

(2)Acrylic resin E-342 is a product of Desoto and is a solvent based modified acrylic copolymer.
(3)Calcined clay is Translink ® 77 calcined clay, a product of Englehard Corporation.

The above ingredients were added as shown and mixed using a Cowles dispersion mixer for 10 minutes. The solution was overcoated onto the previously coated film using a meyer rod and dried at 240° F. (~115° C.) for two minutes to give a dry coating thickness of 5.0 μm to form the electrographic element.

The imaged layer was applied to dielectric surface of the electrographic element formed above, by using a Versatec® V-80 electrostatic plotter operated at conventional plotting conditions.

A protective element was made as follows: An abrasion resistant coating solution was prepared from the following ingredients.

| Ingredient | Parts By Weight |
|---|---|
| Propylene monomethyl ether | 30.41 |
| Ethyl acetate | 26.41 |
| Toluene | 10.96 |
| Butyrolactone | 9.26 |
| Cellulose acetate propionate(4) | 20.06 |
| Hexamethoxymethylmelamine(5) | 2.64 |
| Para-toluene sulfonic acid | 0.53 |
| Amorphous silica (ave. particle size 3 μm) | 0.01 |

(4)Cellulose acetate propionate is C.A.P. 504-0.2 cellulose ester, a product of Eastman Chemicals.
(5)Hexamethoxymethylmelamine is Cymel ® 301 melamineformaldehyde crosslinking resin, a product of Cyanamid Corporation.

The cellulose acetate propionate was added to the solvent blend slowly under a high speed Lightnin® mixer. When fully dissolved, the amorphous silica was then added and mixed for five minutes. The melamine resin and acid catalyst were added and mixed for an additional 15 minutes. The resulting lacquer was then coated on a 25.4 μm (0.001 inch) thick, untreated, polyethylene terephthlate film using a meyer rod and dried at 240° F. (115° C.) for two minutes to give a dry coating thickness of 2.5 μm.

An adhesive layer coating solution was prepared from the following ingredients.

| Ingredient | Parts By Weight |
|---|---|
| Methyl ethyl ketone | 77.96 |
| Toluene | 10.00 |
| Morthane ® CA-116 urethane resin(6) | 12.00 |

-continued

| Ingredient | Parts By Weight |
|---|---|
| Amorphous silica (ave. particle size 3 μm) | 0.04 |

(6)Morthane ® CA-116 urethane resin is a product of Morton-Thiokol and is a hydroxyl terminated polyurethane elastomer.

The coating solution was made by mixing the methyl ethyl ketone, toluene and urethane resin for 30 minutes with a high speed Lightnin® mixer, Amorphous silica was then added and mixed for 5 minutes, The solution was overcoated onto the previously coated film using a meyer rod and dried at 240° F. (115° C.) for two minutes to give a dry coating thicknesses of 2.0 μm to form the protective element.

The laminating steps were performed by first laying the protective element in such a way that the adhesive layer of the protective element and the imaged layer were contacting each other. This composite was then passed through the hot nip of a hot roll laminator at a speed of 2.54 cm per second and at a pressure of 90 kg/cm$^2$. The hot nip consisted of a heated steel roll at a temperature of 115° C. (240° F.) and a hard polyurethane backing roll of a B. F. Perkins laboratory calender. Within 10 seconds of the exit of the laminated element from the hot nip the polyethylene terephthlate support contiguous to the conductive layer was stripped therefrom, The remaining laminate element was then placed on a sheet of 20# xerographic bond paper so that the conductive layer contacted the paper sheet an this composite is then laminated by passing it through the hot nip of the B. F. Perkins laboratory calender at a speed of 2.54 cm per second and at a pressure of 70 kg/cm$^2$ and with the steel roll heated to a temperature of 88° C. (190° F.). After the laminate had cooled to room temperature, the remaining polyethylene terephthalate support was stripped from the protective layer of the paper backed electrographic image. The protected electrographic image produced could withstand scribing with a 4H pencil with no removal of the protective layer or image.

EXAMPLE 2

Example 1 was repeated using the same electrographic and protective elements except that after the first lamination step, wherein the composite of the protective and imaged electrographic elements was passed through the hot nip of a hot roll laminator, the laminated element was cooled to room temperature and stored for 48 hours. The laminated element was again passed through the hot nip (at a temperature of 115° C. (240° F.) of the hot roll laminator at a speed of 2.54 cm per second and at a pressure of 90 kg/cm$^2$. Within 10 seconds of the exit of the reheated laminated element from the hot nip, the polyethylene terephthlate support contiguous to the conductive layer was stripped therefrom without delamination of the thermal adhesive layer or any of the other component layers. The remaining steps of the process were carried out as described in Example 1.

EXAMPLE 3

Example 1 was repeated using the same electrographic and protective elements and the same process steps except that the adhesive layer of the protective element was of the following composition:

| Ingredient | Parts By Weight |
|---|---|
| Toluene | 80.00 |
| Propylene glycol monomethyl ether | 5.00 |
| Polycaprolactone[7] | 15.00 |
| Amorphous silica (ave. particle size 3 μm) | 0.04 |

[7]Polycaprolactone which is Tone ® Polymer P-767E biodegradable plastic resin, a product of Union Carbide.

The coating solution was made by mixing the toluene, propylene glycol monomethyl ether and polycaprolactone for 30 minutes with a high speed Lightnin® mixer. Amorphous silica was then added and mixed for 5 minutes. The solution was overcoated onto the previously coated abrasion resistant film using a meyer rod and dried at 240° F. (115° C.) for two minutes to give a dry coating thickness of 2.0 μm to form the protective element. The remaining steps of the process were then carried out as described in Example 1.

EXAMPLE

Example 1 was repeated using the same electrographic and protective elements and the same process steps except that the abrasion resistant coating solution was prepared from the following ingredients.

| Ingredient | Parts By Weight |
|---|---|
| Propylene glycol monomethyl ether | 30.41 |
| Ethyl acetate | 26.41 |
| Toluene | 10.96 |
| Butyrolactone | 9.26 |
| Cellulose acetate propionate[4] | 20.06 |
| Hexamethoxymethylmelamine[5] | 2.64 |
| Para-toluene sulfonic acid | 0.53 |
| Amorphous silica (ave. particle size 3 μm) | 0.01 |
| Tinuvin ® 1130[8] UV absorber | 1.50 |

[8]Tinuvin ® 1130 UV absorber, a product of Ciba-Geigy, is the reaction product of polyethylene glycol 300 and the methyl ester of beta-(3-(2h-benzotriazole-2-yl)-4-hydroxy-5-tert-butylphenyl)propionic acid.

The cellulose acetate propionate was added to the solvent blend slowly under a high speed Lightnin® mixer. When fully dissolved, the amorphous silica was then added and mixed for five minutes. The melamine resin, acid catalyst and Tinuvin® 1130 UV absorber were added and mixed for an additional 15 minutes. The resulting lacquer was then coated on a 25.4 μm (0.001 inch) thick, untreated, polyethylene terephthlate film using a meyer rod and dried at 240° F. (115° C.) for two minutes to give a dry coating thickness of 2.5 μm. As described in Example 1, the adhesive layer was then prepared and coated and then the remaining steps of the process were carried out.

Those skilled in the art having the benefit of the teachings of the present invention as hereinabove set forth, can effect numerous modifications thereto. These modifications are to be construed as being encompassed within the scope of the present invention as set forth in the appended claims.

What is claimed is:

1. A process for forming an electrographic image on a receptor substrate comprising the steps:

A) producing on the surface of an electrographic element a toned image layer, wherein the electrographic element comprises in the order given;
   1) a first carrier layer,
   2) a conductive layer, and
   3) a dielectric layer, wherein the toned image layer is adhered to the dielectric layer to produce an imaged electrographic element;

B) applying to the toned image layer, a protective element which comprises in the order given;
   4) an adhesive layer,
   5) a protective layer, and
   6) a second carrier layer, wherein the adhesive layer is adhered to the surface of the toned image layer to form an image composite element;

C) removing the first carrier layer from the image composite element to uncover the conductive layer of the image composite element;

D) pressure laminating the receptor substrate to the uncovered conductive layer of the image composite element, to form a laminated image element; and E) removing the second carrier layer from the laminated image element.

2. The process of claim 1 wherein the protective element is applied to the toned image layer under an applied pressure of about 70 kg/cm$^2$ (1,000 p.s.i.) or greater.

3. The process of claim 2 wherein the protective element is applied to the toned image layer under an applied pressure of about 105 kg/cm$^2$ (1,500 p.s.i.) or greater.

4. The process of claim 1 wherein the protective element is applied to the toned image layer at a temperature of about 80° C. or greater.

5. The process of claim 4 wherein the protective element is applied to the toned image layer at a temperature between about 100° C. and about 200° C.

6. The process of claim 1 wherein the protective element is applied to the toned image layer by passing the imaged electrographic element and the protective element in surface-to-surface contact through the nip of pressure rollers to form the image composite element.

7. The process of claim 6 wherein at least one of the elements is heated to a temperature of about 80° C. or greater.

8. The process of claim 7 wherein the first carrier layer is removed from a portion of the image composite element within about 60 seconds from the time at which the portion of the image composite element exits the nip of the pressure rolls.

9. The process of claim 1 wherein the first carrier layer is removed from the image composite element when the image composite element is at a temperature of about 100° C. or greater.

10. The process of claim 1 wherein the receptor substrate is pressure laminated to the contiguous surface of the image composite element under an applied pressure of about 70 kg/cm$^2$ (1,000 p.s.i.) or greater.

11. The process of claim 1 wherein the receptor substrate is pressure laminated to the contiguous surface of the image composite element at a temperature of about 70° C. or greater.

12. The process of claim 1 wherein the first carrier layer is a flexible web or sheet material.

13. The process of claim 12 wherein the flexible web or sheet material is a polymeric film or a foraminous material.

14. The process of claim 1 wherein the conductive layer comprises a film-forming, organic material.

15. The process of claim 14 wherein the film-forming, organic material has an electrical resistivity of about 1 to 30 meg-ohm per □.

16. The process of claim 14 wherein the film-forming, organic material is a polymeric quaternary ammonium compound or a polymeric sulfonic acid compound.

17. The process of claim 14 wherein the film-forming, organic material has dispersed therein a conductive, inorganic material and/or a metal.

18. The process of claim 1 wherein the dielectric layer comprises a film-forming material having a dielectric constant of about 2 to about 5.

19. The process of claim 18 wherein the dielectric layer has a thickness in the range of about 1 μm to about 20 μm.

20. The process of claim 18 wherein the film-forming material contains ingredients selected from the group consisting of waxes, polyethylene, alkyd resins, nitrocellulose, ethylcellulose, cellulose acetate, shellac, epoxy resins, styrene-butadiene copolymers, clorinated rubbers, and polyacrylates.

21. The process of claim 1 wherein the dielectric layer comprises one or more polymers selected from group consisting of polyvinylacetate, polyvinylchloride, polyvinylbutyral, polymethylmethacrylate, styrenated acrylics, styrene, and acrylonitrile.

22. The process of claim 1 wherein the second carrier layer is a flexible web or sheet material.

23. The process of claim 22 wherein the flexible web or sheet material is a polymeric film or a foraminous material.

24. The process of claim 22 wherein the flexible web or sheet material is surface treated with a release agent.

25. The process of claim 1 wherein the protective layer comprises a polymeric film material.

26. The process of claim 25 wherein the polymeric film material is taken from the group consisting of polyvinyl chloride; polyvinyl butyral; cellulose acetate propionate; cellulose acetate butyrate; polyesters; acrylics; polyurethanes; styrene copolymers; styrene acrylonitrile; and combinations thereof.

27. The process of claim 1 wherein the protective layer is visually transparent in at least one region within the visible spectral region.

28. The process of claim 1 wherein the protective layer has a thickness in the range of about 0.5 μm to about 10 μm.

29. The process of claim 1 wherein the protective layer will withstand scribing with the point of a 4H pencil without breakthrough.

30. The process of claim 1 wherein the adhesive layer comprises a thermally activated adhesive material.

31. The process of claim 30 wherein the thermally activated adhesive material is a thermoplastic polyurethane, polycaprolactone, acrylic copolymer, or combinations thereof.

32. The process of claim 1 wherein the adhesive layer is visually transparent in at least one region within the visible spectral region.

* * * * *